United States Patent [19]

Amstutz et al.

[11] Patent Number: 4,980,998

[45] Date of Patent: Jan. 1, 1991

[54] WALL SYSTEM

[75] Inventors: Douglas D. Amstutz, Muskegon, Mich.; Adrienne Weiss, Chicago, Ill.

[73] Assignee: Amstore Corporation, Muskegon, Mich.

[21] Appl. No.: 294,245

[22] Filed: Jan. 6, 1989

[51] Int. Cl.[5] ..... G09F 13/04

[52] U.S. Cl. ..... 52/28; 52/38; 40/549; 40/564

[58] Field of Search ..... 52/38, 27, 28, 241, 52/239, 238, 241; 40/568, 564, 549, 575, 580, 540, 541, 538; 211/182, 189

[56] References Cited

U.S. PATENT DOCUMENTS

| | | | |
|---|---|---|---|
| 1,787,355 | 12/1930 | Brown | 40/580 |
| 2,689,422 | 9/1954 | Hoff | 40/580 |
| 3,101,817 | 8/1963 | Rader | 52/241 |
| 3,201,579 | 8/1965 | Harper | 52/38 |
| 3,396,483 | 8/1988 | Stein | 40/549 |
| 3,562,942 | 2/1971 | Mabrey | 40/570 |
| 3,824,726 | 7/1974 | Schubert | 40/564 |
| 3,905,139 | 9/1975 | Looper | 40/568 |
| 4,041,667 | 8/1977 | Linder | 52/241 |
| 4,516,343 | 5/1985 | Stilling | 40/549 |
| 4,754,582 | 7/1988 | Cameron | 52/28 |
| 4,831,759 | 5/1989 | Hosey | 40/564 |

*Primary Examiner*—John E. Murtagh

*Attorney, Agent, or Firm*—Warner, Norcross & Judd

[57] ABSTRACT

A wall system for partitioning floor space includes a framework comprising top and bottom horizontal rails interconnected by a plurality of vertical struts. The wall system further includes the use of diagonal support bars for open frame structures and the use of side and septum display panels for closed frame structures.

Also, structural inserts may be inserted between adjacent struts to reinforce open framed structures. Such inserts are planar members with an irregular perimeter edge which defines an aesthetic design for use in assembling attractive displays. Additionally, such inserts may be used in conjunction with translucent panels and lighting fixtures to create a silhouette affect for the assembled display.

11 Claims, 8 Drawing Sheets

WALL SYSTEM

BACKGROUND OF THIS INVENTION

The present invention pertains to wall systems, and in particular, to a wall system specially suited for partitioning the floor space of retail establishments into various display areas.

In retail establishments, the available floor space is often partitioned to separate differing goods and permit various displays to be attractively set up independently of one another. However, wall partitions heretofore have been unwieldy, complicated, expensive and/or lacking in versatility. Furthermore, partitions spanning and significant length of the floor have either needed to be anchored to a perimeter wall or ceiling along their top edges, or have required laterally projecting legs every few feet for stability.

As can be readily appreciated, these options have serious drawbacks. The necessity of anchoring the partitions to a perimeter wall or ceiling of the building, substantially limits the placing of the partitions and/or the type of displays which may be assembled. While use of laterally projecting legs increases the versatility of the wall systems, the legs themselves create annoying obstructions which must be worked around in setting up the displays, detract from the appearance of the displays, and at times cause hazards for shoppers and employees.

SUMMARY OF THE INVENTION

The aforementioned problems and deficiencies are overcome in the present invention, wherein a unique wall system having a novel construction is provided which offers great versatility to the user.

The wall system of the present invention includes a structural framework which is easy to assemble, inexpensive to fabricate and has sufficient rigidity to permit large spans, of up to twenty feet between anchoring means, to be erected without intermediate top anchoring arrangements or laterally projecting legs. Moreover, the structure permits a wide diversity of display arrangements to be utilized, and thus provides an enormous amount of versatility.

As another aspect of the present invention, the wall system further includes structural inserts for use in reinforcing open frame structures. The inserts are planar members having irregular perimeter edges which preferably define an aesthetic design, such as a monkey, human form, etc. Such inserts may also be utilized in conjunction with translucent panels and lighting fixtures to create attractive silhouettes to be viewed by the public.

These and other objections, advantages and features of the invention will be more readily understood and appreciated by reference to the detailed description of the preferred embodiment and the drawings.

DETAILED DESCRIPTION OF THE PREFERRED EMBODIMENT

Figure 20:
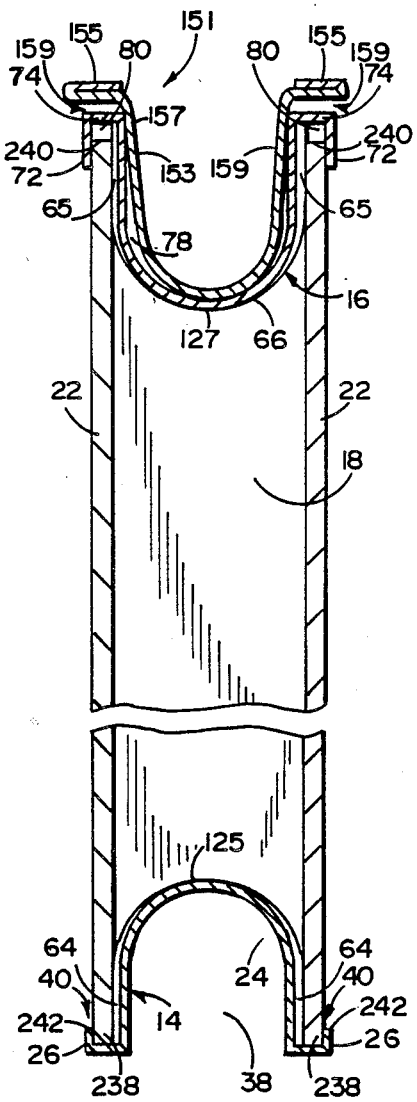
FIG. 20 is a cross-sectional view taken along line XX—XX in FIG. 3 with the addition of two display panels.
Figure 29:
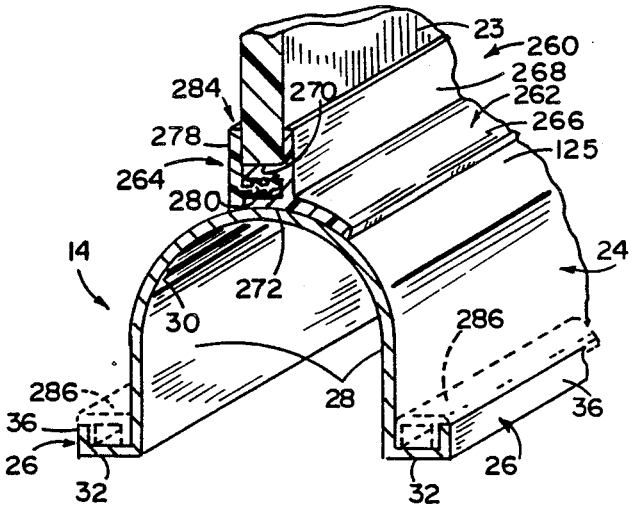
FIG. 29 is a cross-sectional view taken along line XXIX—XXIX in FIG. 28.

The wall system 10 of the present invention includes an open framework 12 comprised of a bottom rail 14, a top rail 16 and a plurality of vertical struts 18 interconnecting the two rails 14, 16. The erected wall 20 has sufficient rigidity to span up to twenty feet of floor space. Further, the wall 20 can be assembled as an open structure (FIG. 1) or a closed structure utilizing display panels 22, 23 (FIGS. 20 and 29).

Bottom rail 14 is preferably an elongated metal member composed of steel or aluminum (FIGS. 4–7). Of course other materials having the requisite strength could be used. Bottom rail 14 is typically machine formed from a blank sheet; although other methods of manufacture, such as extrusion, could be used. Bottom rail 14 is configured to have a central body portion 24 and a pair of opposite side flanges 26. Body portion 24 has an inverted U-shape defined by a pair of legs 28 and an interconnecting, rounded bight segment 30. Side flanges 26 are L-shaped and each include a base leg 32 adapted to lie along the floor 34, and an upstanding leg 36 oriented substantially parallel to legs 28. Bottom rail 14, then, defines a large inner channel 38 within body portion 24 and a pair of shallow outer channels 40 between each leg 28 and one upstanding leg 36.

Figure 11:
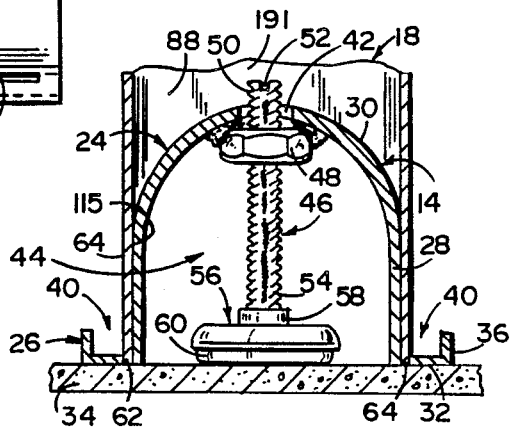
FIG. 11 is a cross-sectional view taken along line XI—XI in FIG. 1.
Figure 14:
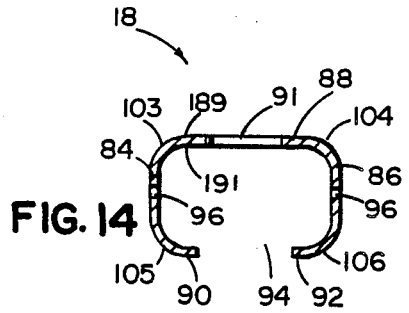
FIG. 14 is a cross-sectional view taken along line XIV-XIV in FIG. 13.
Figure 12:
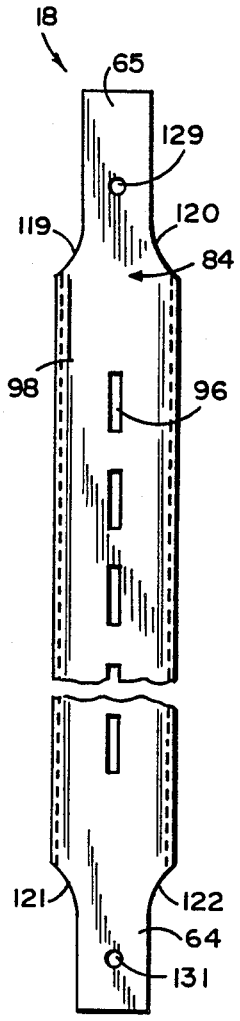
FIG. 12 is a front elevational view of a vertical strut of the wall system.
Figure 13:
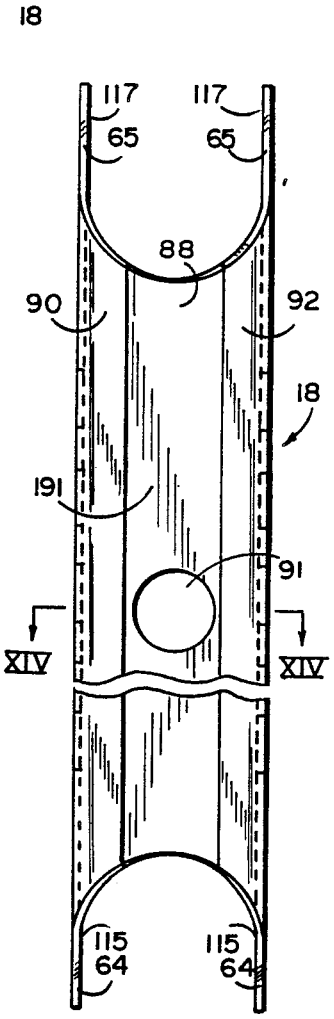
FIG. 13 is a side elevational view of the vertical strut.

A series of spaced apart holes 42 are defined along the ridge of bight segment 30. Holes 42 are provided to permit access to and provide adequate head space for leveling devices 44 positioned within inner channel 38 (FIG. 11). Each leveling device 44 includes a threaded rod 46 received through a weld nut 48 for vertical adjustment thereof. Rod 46 includes an upper end 50 defining a slot 52 for receiving a conventional screw driver (not shown), and a lower end 54 rotatably attached to a foot 56. Foot 56 preferably defines a socket 58 for receiving and retaining rod 46, and a pad 60 for engaging the floor 34. Leveling devices 44 are manually operated in the erection of the wall 20, until bottom rail 14 assumes a substantially true horizontal position.

A row of slots 62 are defined in each base leg 32 in general alignment with holes 42 (FIGS. 4–7). Slots 62 are elongated, narrow openings positioned directly adjacent legs 28 of body portion 24. Slots 62 are provided to receive projections 64 extending from struts 18, as will be discussed below.

Top rail 16 is an elongated member positioned in a substantially parallel relation to bottom rail 14. Top rail 16 is preferably composed of steel or aluminum, but could be composed of other materials having the requisite strength and rigidity. As with bottom rail 14, top rail 16 is preferably machine formed from blank stock, but could be formed by other techniques, such as extrusion.

Top rail 16 has a similar shape to bottom rail 14, although with an inverted orientation. More specifically, top rail 16 includes a U-shaped body portion 66 defined by a pair of legs 68 and a rounded bight segment 70, and a pair of L-shaped side flanges 72 each having a base leg 74 and vertical leg 76. Defined inner and outer channels 78, 80 of top rail 16 each have a greater depth than their counterpart on bottom rail 14. A series of spaced apart slots 82 are provided in base leg 74 adjacent legs 68 of body portion 66. Each slot 82 in the rail 16 is aligned with a corresponding slot 62 defined in bottom rail 14. Top slots 82 cooperate with bottom slots 62 to receive strut projections 64, 65 and thereby retain each strut 18 in place.

Struts 18 are vertically positioned between the two rails 14, 16 and have lengths sized to the desired height of the wall 20 (FIGS. 1, 3–4 and 12–14). Generally, struts 18 are spaced at two foot centers, though other spacing arrangements could be used. Struts 18 are preferably composed of steel or aluminum, although other materials having the requisite strength could be used. Struts 18 are also preferably fabricated by machine forming of blank stock but other techniques, such as extrusion may be used.

Each strut 18 is an elongated member having a generally rounded C-shaped cross-sectional configuration. This shape is defined by identical front and rear walls 84, 86, a sidewall 88 extending between walls 84, 86, and a pair of inturned side segments 90, 92 projecting inwardly from walls 84, 86, respectively. Sidewall 88 generally includes openings 91 for receiving electrical conduit 93 or the like therethrough. Side segments 90, 92 are substantially aligned with one another and define therebetween a gap 94. Gap 94 may be covered by a removable cover 95 if desired. Cover 95 can be snap fit in place, or secured by any known means.

Figure 1:
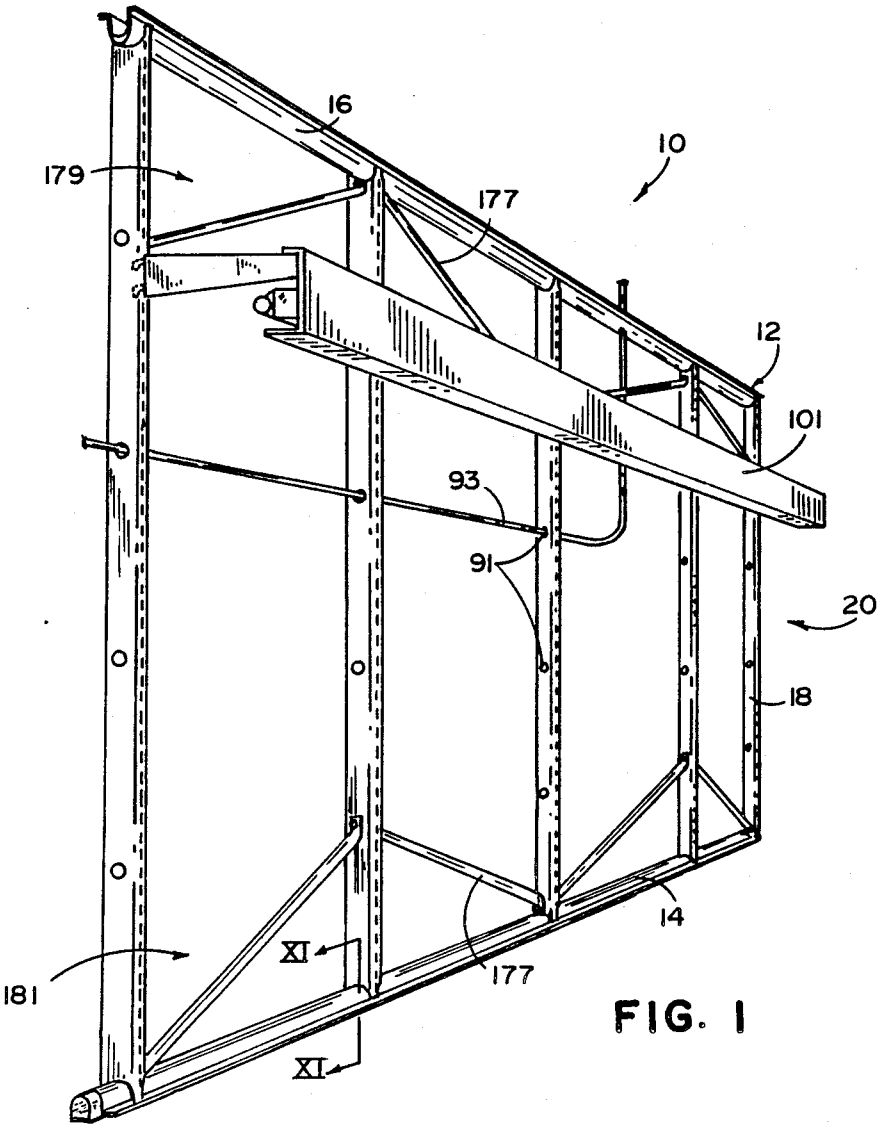
FIG. 1 is a perspective view of an open wall structure of the present invention.

Front and rear walls 84, 86 each define a plurality of vertically aligned openings 96 along a central portion 98, 99 thereof. Openings 96 have narrow rectangular shapes and are adapted to receive conventional bracket hooks in the mounting of various items, such as shelves, lighting fixtures, etc. In FIG. 1, a cornice 101 is shown mounted in such a manner. The row of openings 96 extend along substantially the entire length of each strut 18 to accommodate the mounting of items at a wide range of elevations.

Central portions 98, 99 of walls 84, 86 are substantially planar in shape, as are sidewall 88 and side segments 90, 92. These planar portions are connected by smooth, continuous rounded corners 103–106. At the upper and lower ends 111, 113 of each strut 18, central portions 98, 99 extend longitudinally beyond corners 103–106, sidewall 88 and side segments 90, 92, to define upper and lower projections 65, 64.

When wall 20 is assembled, projections 64, 65 are received within slots 62, 82 of rails 14, 16 to retain the strut 18 in its proper position (FIGS. 4, 11, 15 and 23). Inner surfaces 115, 117 of projections 64, 65 then lie contiguously along legs 28, 68 of rails 14, 16, respectively. This arrangement, in turn, places sidewall 88, side segments 90, 92 and corners 103–106 between opposed body portions 24, 66. The upper and lower edges 119–122 of these intermediate portions are rounded to conform and engage convex faces 125, 127 of body portions 24, 66. Upper edges 119, 120 are substantially the same as lower edges 121, 122, respectively, except that upper edges 119, 120 have a deeper arcuate shape to correspond to the larger size of the upper body portion 66 as compared to lower body portion 24. This engaged arrangement provides a sturdy and attractive appearance.

Figure 4:
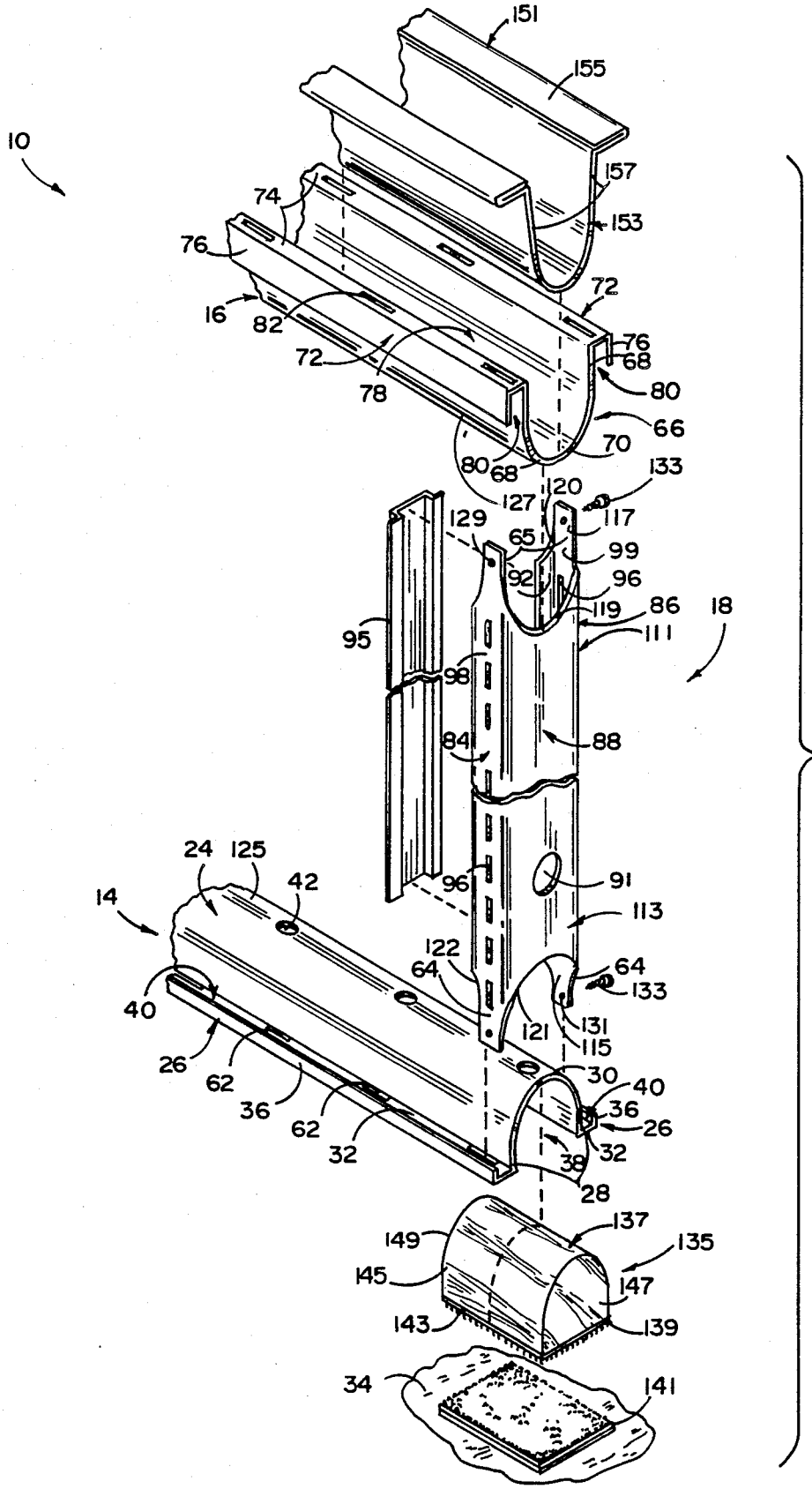
FIG. 4 is an exploded, fragmentary, perspective view of the wall structure.
Figure 5:
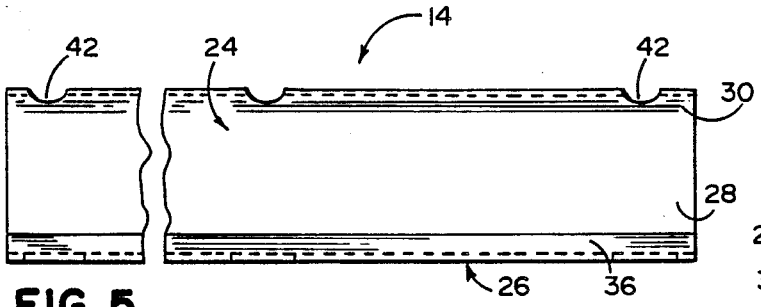
FIG. 5 is a front elevational view of a bottom rail of the wall system.
Figure 7:
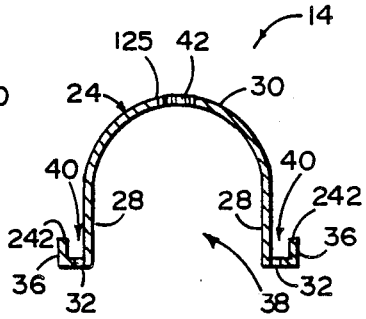
FIG. 7 is a cross-sectional view taken along line VII—VII in FIG. 6.
Figure 6:
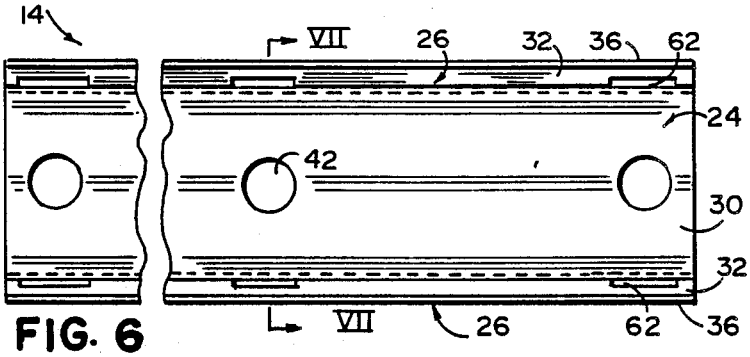
FIG. 6 is a top plan view of the bottom rail.
Figure 8:
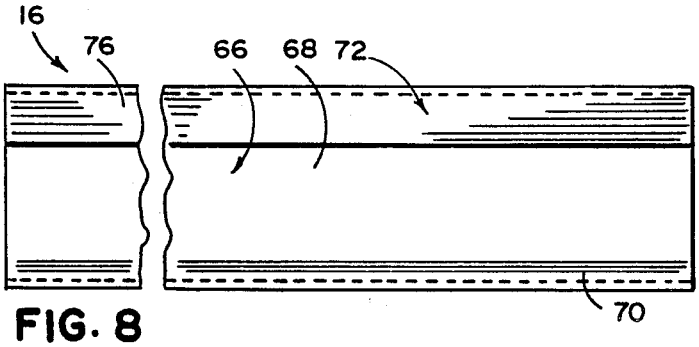
FIG. 8 is a front elevational view of a top rail of the wall system.
Figure 10:
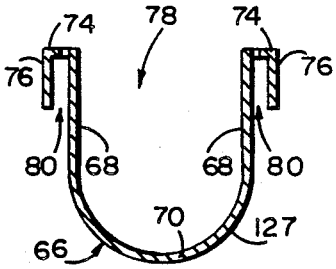
FIG. 10 is a cross-sectional view taken along line X—X in FIG. 9.
Figure 9:
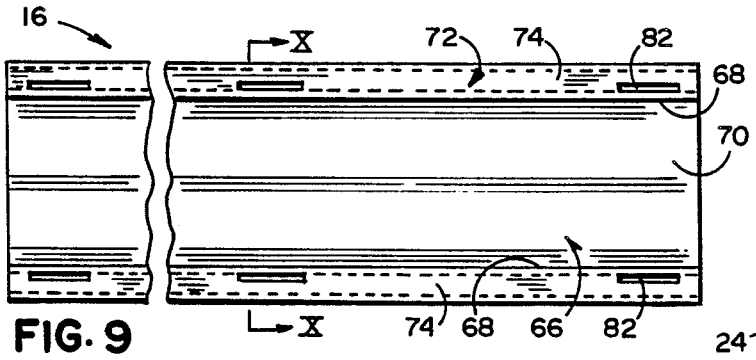
FIG. 9 is a top plan view of the top rail.

Top and bottom mounting holes 129, 131 are provided in projections 65, 64, respectively, in order to couple struts 18 securely to rails 16, 14 (FIG. 4). More specifically, screws 133 (preferably sheet metal screws) are passed through holes 131, 129 and threaded into legs 28, 68 of rails 14, 16, respectively. Only one screW 133 in each end 111, 113 of strut 18 need be used to erect a stable wall 20. Of course, a screw 133 in each mounting hole 129, 131 may be used if desired.

Figure 16:
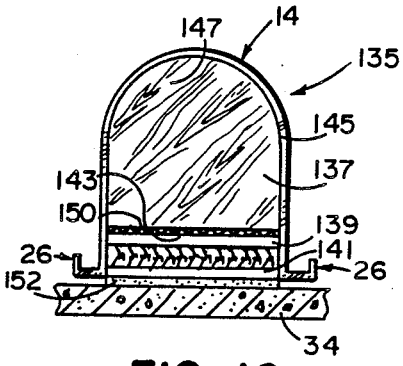
FIG. 16 is a partially exploded end view of the bottom rail including an anchoring device.
Figure 17:
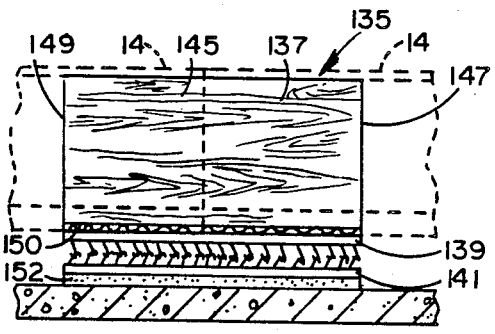
FIG. 17 is a partially exploded front elevational view of the anchoring device with the bottom rail shown in phantom.
Figure 15:
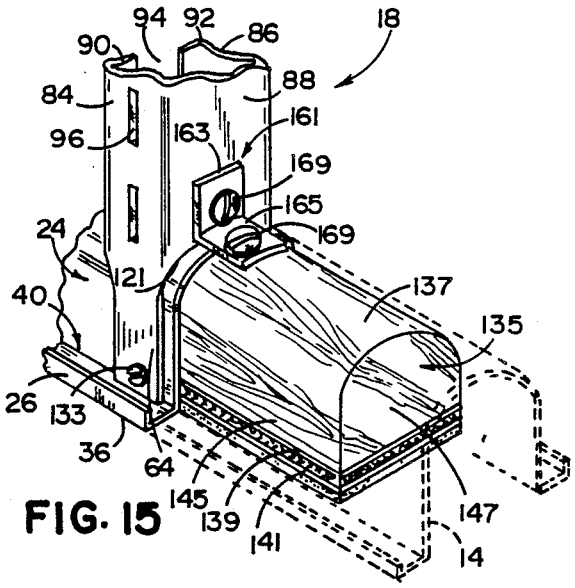
FIG. 15 is a fragmentary perspective view of a pair of joined bottom rails of two aligned walls with the bottom rail of one wall shown in phantom.

The bottom of the walls 20 are secured against lateral sliding movement along the floor 34 by anchoring devices 135 (FIGS. 15–17). Under normal circumstances, anchoring devices 135 are positioned at the ends of each particular wall 20—which will typically be at ten feet intervals. Of course, anchoring devices could be positioned at any shorter interval if desired.

Each anchoring device 135 is comprised of a block 137 and two interlocking sheets of hook and loop type fasteners 139, 141 (i.e. VELCRO type fasteners). More specifically, block 137 is preferably composed of wood, but could be composed of other materials having the required characteristics. Block 137 includes a base surface 143, an arcuate surface 145 and two end surfaces 147, 149. Arcuate surface 145 is sized and shaped to generally conform to the shape and size of inner channel 38 of bottom rail 14, so that block 137 is adapted to be received therein. When block 137 is positioned at the end of a wall 20 not to be joined to an aligned wall, it is received wholly within the bottom rail 14. However, when it is placed at the interconnection of two adjacent, aligned walls 20, 20' (as discussed below), block 137 is positioned to extend into both bottom rails (FIGS. 15 and 17).

Sheets 139, 141 are secured to base surface 143 and floor 34, respectively, through the use of conventional adhesives 150, 152 (as illustrated in an exaggerated manner in FIGS. 16 and 17). The use of hook and loop fastener sheets 139, 141 and adhesives 150, 152 permits the bottom rails to be securely anchored against sliding, without marring or destroying the floor surface. In the event, that walls 20 are to be rearranged, the anchoring devices 135 can be removed without requiring the floor 34 to be repaired, as is the case when bolts are used.

A top stabilizing rail 151 is provided to rigidify wall 20 and preclude lateral sagging in the top rail 16 (FIGS. 4, 18–20 and 22). Stabilizing rail 151 is generally only used to strengthen an unanchored rail 16. If top rail 16 extends along a perimeter wall or ceiling, it may be securely anchored thereto by well-known brackets and/or bolts. Stabilizing rail 151 is preferably composed of steel or aluminum and is fabricated by a machine forming process. Other materials, though, having the requisite strength and rigidity could be used.

Stabilizing rail 151 includes an elongated generally U-shaped trough 153 and a pair of seamed flanges 155 extending along each side thereof. Each seamed flange 155 is comprised of two thicknesses of the sheet folded back upon one another. This construction greatly increases the stabilizing rail's resistance to lateral bending. The sides 157 of trough 153 are diverging slightly to ensure a secure engagement is made along the upper ends of legs 68 of top rail 16.

In use, stabilizing rail 151 is received within inner channel 78 of top rail 16. A gap 159 is defined between seamed flanges 155 and base legs 74 (FIGS. 20, 22 and 23), to provide space for derivations in the lengths of the struts 18, and to provide some vertical freedom of movement for stabilizing rail 151 to account for derivations in the width of inner channels 78.

Top and bottom rails 16, 14 preferably are formed with ten foot lengths to define walls 20 with spans of ten feet. At times in the assembly of display areas, walls having greater lengths than ten feet are desired. In such situations, two aligned walls 20 are placed in end-to-end abutment with each other. Two generally L-shaped joining brackets 161 are provided to join the walls together (FIGS. 3, 15, 21 and 22). Furthermore, if provided, stabilizing rail 151 is sized and positioned so that it does not end at the seam 167 between two joined walls 20, to provide additional reinforcement.

Joining brackets 161 are preferably formed of steel, although other materials having sufficient strength could be used. Each joining bracket 161 includes a strut plate 163 and a rail plate 165. Strut plates 163 have substantially planar configurations and abuttingly engage the outer faces 147 of strut sidewalls 88. Rail plates 165 have arcuate shapes which conform and engage along the ridges of convex faces 125, 127 of rails 14, 16, respectively.

In use, joining brackets 161 are placed over the seams 167 formed by the abutting walls 20 (FIGS. 3, 15, 21 and 22). More specifically, one joining bracket 161 is placed against the lower end 113 of strut 18 and bottom rail 14. Another joining bracket 161 is placed against the upper end 111 of strut 18 and top rail 16. Both plates 163, 165 of each joining bracket define apertures through which joining screws 169 (preferably sheet metal screws) are passed. In the most preferred embodiment, one joining screw is passed through strut plate 163 and two through rail plate 165. Of course this screw arrangement could be modified. In any event, joining brackets 161 in cooperation with joining screws 169 securely, but releasably, join the walls together.

Figure 26:
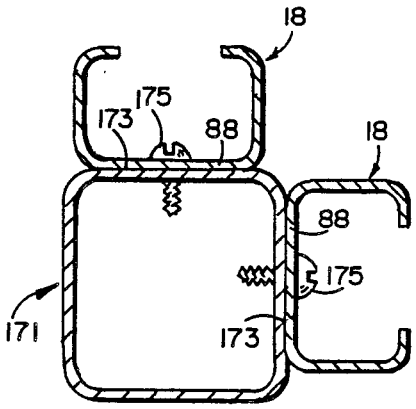
FIG. 26 is a cross-sectional view taken along lines XXVI—XXVI in FIG. 3.
Figure 26A:
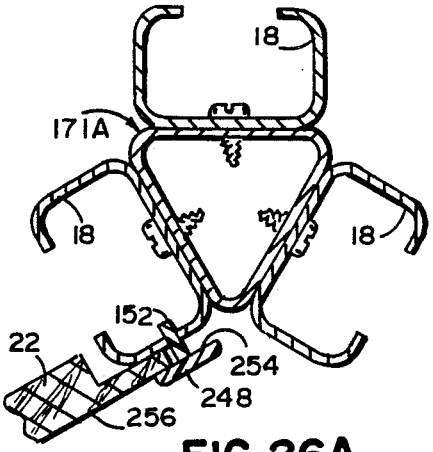
FIG. 26A is an alternative coupling post joining three non-aligned walls.

Also, at times, walls 20 are joined together at angles to one another. In these situations, a coupling post 171 is used (FIGS. 2, 3, 26 and 26A). Coupling post 171 is preferably composed of steel or aluminum (although other materials with the required strength could be used); and has a tubular construction. The cross-sectional shape of the post 171 will vary depending upon the angle at which the non-aligned walls 20 are to be joined. For example, as seen in FIG. 26, coupling post 171 is substantially square (or rectangular) so that coupling faces 173 are placed at right angles to one another. Alternatively, as illustrated in FIG. 26A, the coupling post 171A could have a triangular shape to form the hub for three intersecting walls. Coupling posts 171, then, can have many diverse shapes to meet the needs of the display to be erected.

Figure 2:
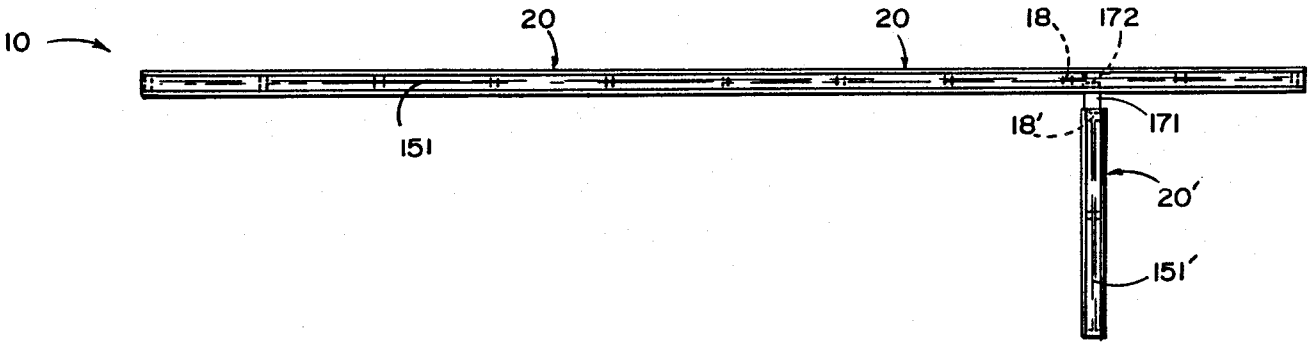
FIG. 2 is a top plan view of the wall system including two perpendicular walls joined together.
Figure 3:
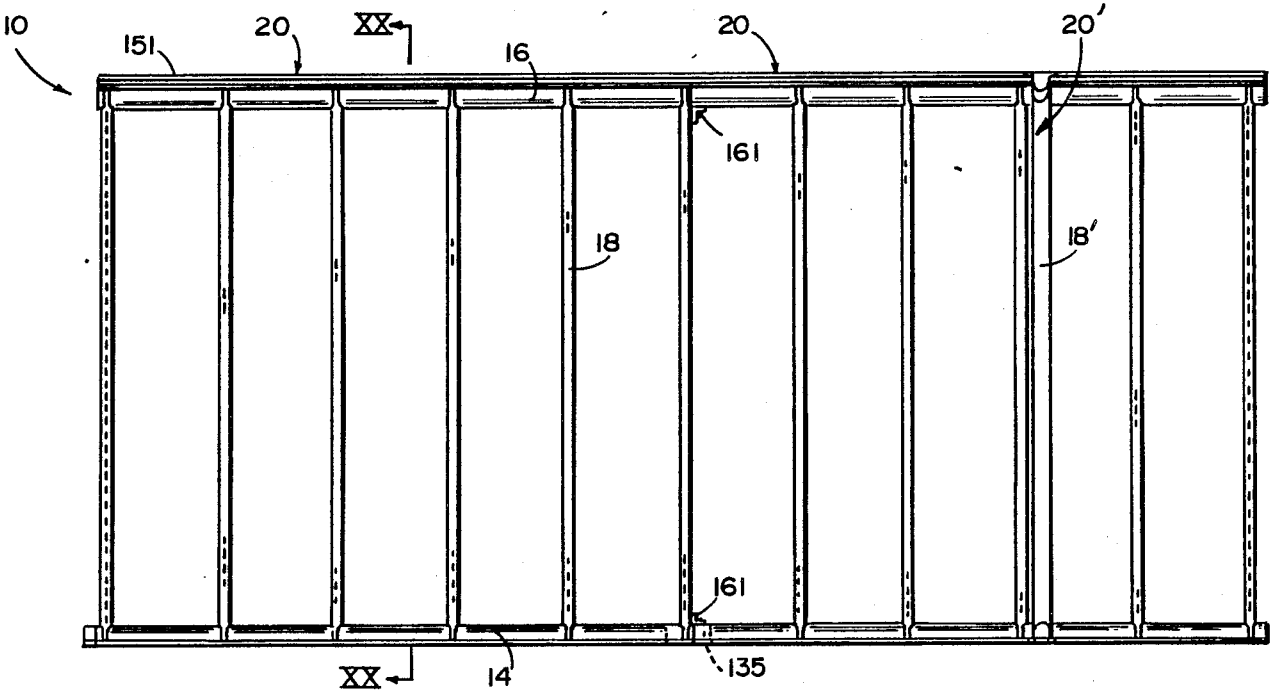
FIG. 3 is a front elevational view of the wall system illustrated in FIG. 2.

In certain situations, such as illustrated in FIGS. 2 and 3, connectors 172 may be used to connect struts 18 to post 171. For example, in the embodiment of FIGS. 2 and 3, coupling post 171 is positioned along side of wall 20 and adjacent the end of wall 20'. In this arrangement, post 171 is directly attached to the end strut 18' of wall 20' (in a manner as shown in FIG. 26). However, a connector 172, having for example an L-shape, is used to connect sidewall 88 of strut 18 in wall 20 to coupling face 173 of post 171. In any event, irrespective of whether connectors 172 are used, coupling posts 171 are merely used as connectors and do not generally engage the floor or other supporting structures.

To join non-aligned adjacent walls 20 together at a hub, a coupling post 171 is placed flush against a strut 18 of each wall span to be joined (FIGS. 26 and 26A); such that the appropriate coupling faces 173 engage the strut sidewalls 88 along their lengths. These abutting surfaces are then securely attached by a series of vertically spaced coupling screws 175 (preferably sheet metal screws). Struts 18 and coupling posts 171 will typically be drilled at the site during erection of the walls for the passage of screws 175. Nevertheless, holes may be preformed for prefabrication units.

Figure 24:
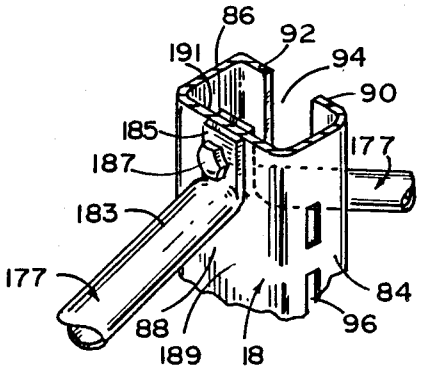
FIG. 24 is a fragmentary perspective view of two diagonal supporting bars to a vertical strut.
Figure 21:
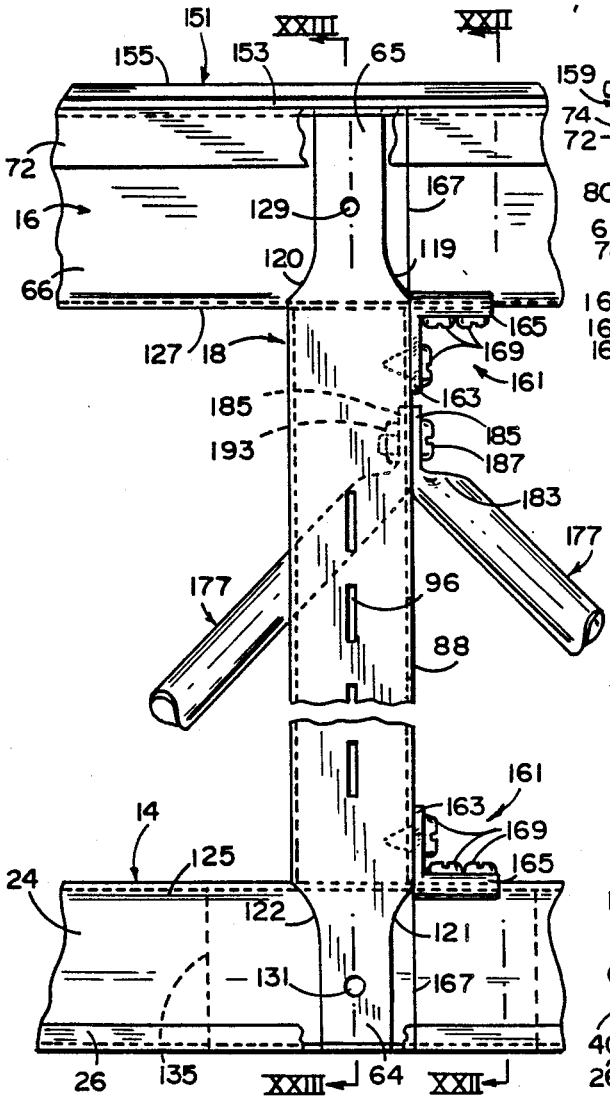
FIG. 21 is a fragmentary front elevational view of two walls joined together.
Figure 22:
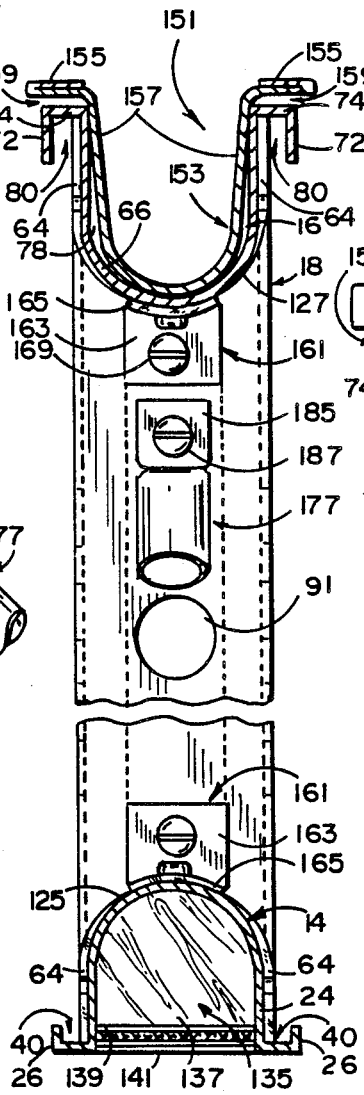
FIG. 22 is a cross-sectional view taken along line XXII—XXII in FIG. 21.
Figure 23:
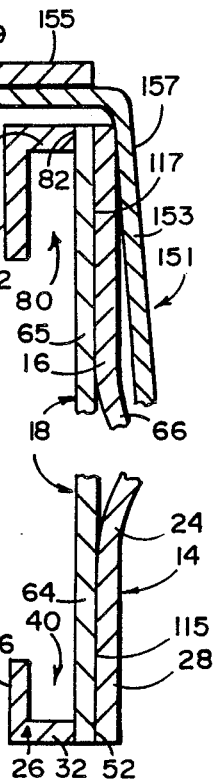
FIG. 23 is a fragmentary cross-sectional view taken along lines XXIII—XXIII in FIG. 21.

When wall 20 is to be assembled as an open frame structure, diagonal support bars 177 are provided between adjacent struts 18 (FIGS. 1, 21 and 24). Bars 177 are arranged into upper and lower sets of supports 179, 181 which span the entire length of wall 20. Each set of supports 179, 181 collectively define an serpentine or serrated path. In the most preferred embodiment, the two bars 177 between each pair of struts 18 are parallel with each other to provide a more rigid framework 12.

Each support bar 177 is preferably formed as a tubular member composed of steel or aluminum, although other materials having the requisite strength and rigidity could be used. Each end 183 thereof is flattened and bent to define a tab 185. Tabs 185 are preferably bent at a 45° angle to the longitudinal axis of bar 177, to mount bar 177 at a 45° slope. Of course these angeles could be modified.

To mount bars 177 to struts 18, tabs 185 are provided with bores (not shown) which are adapted to receive therethrough coupling bolts 187. More particularly, each rod 177 is positioned such that one tab 185 engages the outer face 189 of sidewall 88 of one strut 18 and the opposite tab 185 engages the inner face 191 of sidewall 88 of an adjacent strut 18. Gaps 94 are therefore shaped slightly larger than the diameters of bars 177, so that the bars 177 can be easily received therethrough for mounting. Once two tabs 185 are engaged opposite to each other on a sidewall 88, a coupling bolt 187 may be inserted and secured with a corresponding nut 193.

Figure 30:
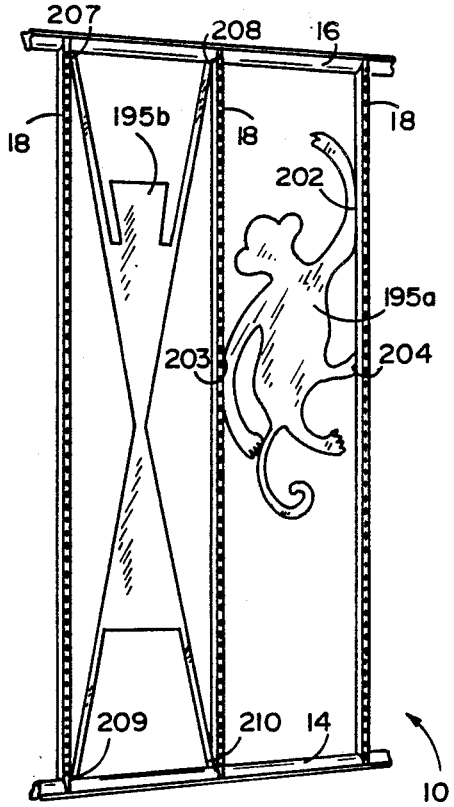
FIG. 30 is a fragmentary perspective view of the wall structure provided with structural inserts of alternative designs.
Figure 18:
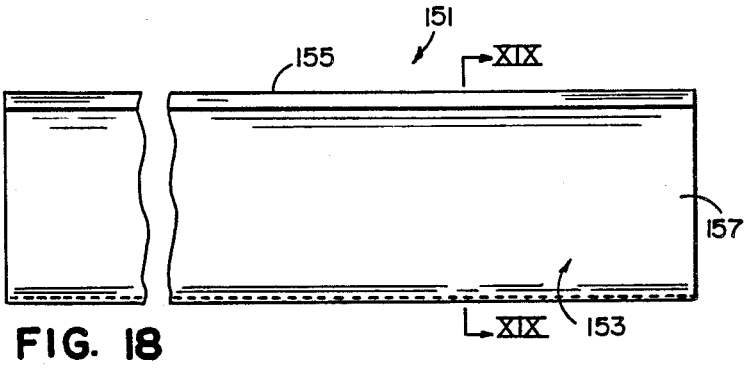
FIG. 18 is a front elevational view of a top stabilizing rail of wall system.
Figure 19:
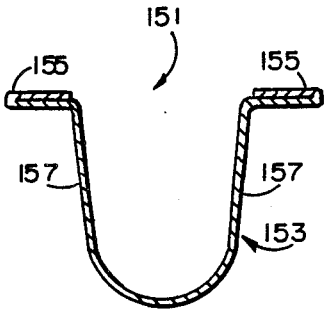
FIG. 19 a cross-sectional view taken along line XIX—XIX in FIG. 18.

Alternatively, an opened framed wall 20 can be reinforced by structural inserts 195, in place of diagonal support bars 177. More particularly, inserts 195 are generally solid planar members composed of steel or other rigid or semi-rigid material. Although, various non-solid structures, such as perforated or grid members, providing the members have sufficient rigidity to effectively reinforce wall 20, could also be used. Moreover, inserts 195 are preferably provided with an irregular perimeter edge 196 shaped with an aesthetic design enabling more attractive and creative displays to be assembled. For instance, as seen in FIG. 30, an insert shaped as a monkey 195A for use in a children's department or an abstract human FIG. 195B for use in a clothing department could be provided. Of course an infinite variety of shapes could be used.

Figure 31:
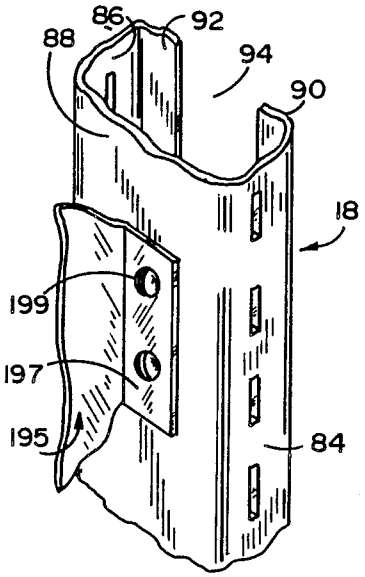
FIG. 31 is a fragmentary perspective view of a structural insert attached with a vertical strut.

Inserts 195 are secured to the adjacent struts 18 by securing flanges 197 and cooperating screws 199 (FIG. 31). As seen in FIG. 30, various portions 202–204 and 207–210 for the monkey design 195A and the human design 195B, respectively, engage opposite struts 18. At these engaged portions 202–204 and 207–210, inserts 195A and 195B, respectively, are provided with securing flanges 197 (FIG. 31). Securing flanges 197 are bent at right angles to the shaped body portions of the inserts so that they lie flush against the inner and outer faces 189, 191 of strut sidewalls 88. Screws 199 (preferably sheet metal screws) are used to fasten inserts 195 in place and rigidify the wall 20. Again, as with the mounting of coupling post 171, holes (not shown) for screws 199 are typically drilled at the site, but could be formed at the plant in a prefabricated display.

Additionally in an open frame structure, removable decorative covers 212 may be provided over vertical struts 18, 18' (FIGS. 25A–D). Preferably, covers 212 are utilized in conjunction with alternative vertical struts 18' but could in some cases be attached to struts 18. Alternative struts 18' are identical in function, and similar in shape, to vertical struts 18 discussed above. More particularly, each strut 18' includes front and rear walls 84', 86', a sidewall 88', and a pair of side segments 90', 92' which are planar in shape and interconnected by squared corners 103'–106'. Furthermore, sidewall 88' includes an offset portion 214 defining shoulders 215 which are provided to mount several types of covers 212. The ends (not shown) of struts 18' are fashioned and interconnected to rails 14, 16 in the same manner as discussed above for struts 18.

Figure 25A:
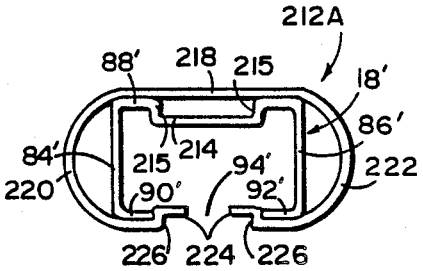
FIGS. 25A–25D are end views of alternative vertical struts provided with various decorative covers.
Figure 25B:
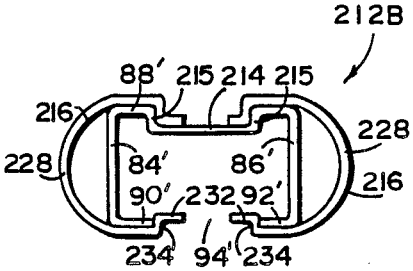
Figure 25C:
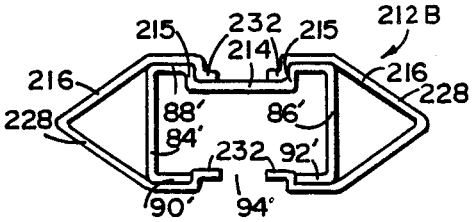
Figure 25D:
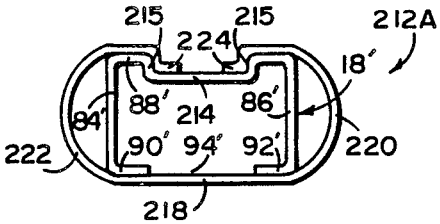

Covers 212 are preferably fabricated as elongated resilient plastic extrusions of various shapes, sizes and colors (FIGS. 25A–D). Covers 212 may also be fabricated as a single unitary piece or as a pair of cover pieces 216. The unitary covers 212A are primarily intended for use on walls 20 that may be anchored along their upper edge to a perimeter wall or ceiling, and thereby do not require diagonal support bars 177. However, these may be accommodated if the covers 212A are cut to appropriate lengths and positioned to provide access for the mounting of the bars 177 to struts 18, 18'. Moreover, unitary covers 212A, if mounted in the manner as shown in FIG. 25A, may be installed on primary vertical struts 18. The separable covers 212B comprised of cover pieces 216 may easily be used with support bars 177, since the sidewall 88 is not entirely covered with the cover pieces 216. Furthermore, covers of different shapes, sizes and/or colors may be mixed and matched on different sides of struts 18' (or used on only one side) to meet the specific needs of the different displays in the retail establishments.

Unitary covers 212A each include a side member 218, front and rear members 220, 222, and a pair of locking segments 224. Side members 218 are generally planar in shape and are adapted to engage and cover either the sidewalls 88' (FIG. 25A) or side segments 90', 92'(FIG. 25D) of struts 18'. Front and rear members 220, 222 are the portions to be primarily visible to the public. Accordingly, front and rear members 220, 222 may have a variety of shapes, sizes and colors. Locking segments 224 each have an L-shaped free end 226 adapted to interlock with either shoulders 215 of sidewall 88' (FIG. 25D) or side segments 90', 92' (FIG. 25A). In attaching a unitary cover 212A, one locking segment 224 is generally hooked on one shoulder 215 or side segment 90' or 92' and resiliently deformed and stretch to snap-fit lock on the strut 18'.

Separable cover pieces 212B include front members 228 of any shape, size or color which are bordered on each end by a locking segment 232. Locking segments 232 are L-shaped at their free ends 234 and are adapted to engage the offset section 214 of sidewall 88' and side segments 90', 92'. In a manner similar to unitary covers 212A, covers 212B are attached to struts 18' by hooking one locking segment 232 on either one shoulder 215 or side segment 90' or 92' and resiliently deforming and stretching the cover to snap-fit lock it on the front or rear of the strut 18'.

When wall 20 is to be assembled as a closed frame structure, a plurality of display panels 22 may be installed between rails 14, 16. Display panels 22 are preferably solid rectangular members composed of plastic (or other suitable material) and having any color or surface texture. Furthermore, display panels 22 may be transparent, translucent or mirrored; or even irregular non-solid structures, such as perforated sheets or a rigid grid of vertical and horizontal members. Panels fabricated of a rigid framework covered by a fabric may also be used. In any event, display panels 22 are to be installed between each strut 18 and extend the entire height between rails 14, 16.

Display panels 22 are held along their lower and upper edges 238, 240 by outer channels 40, 80, respectively. Display panels 236 are installed by inserting upper edge 240 into top outer channel 80 until the edge 240 engages top base leg 74. In this position, lower edge 238 will clear the free end 242 of upstanding leg 36 so that the panel 22 may be swung toward rail 14 and be aligned with lower outer channel 40. At this point, display panel 22 is lowered and set upon lower base leg 32. As seen in FIG. 20, vertical leg 36 is sufficiently long to still retain the upper edge 240 of display panel 22 when set down in channel 40. These panels 22 may be installed in either or both sets of outer channels 40, 80, depending upon the specific needs of the displays to be assembled.

The side edges 244 of display panels 22, when installed, overlie a portion of front or rear wall 84, 86 of strut 18. More specifically, side edges 244 lie adjacent to the row of openings 96 such that a gap 246, aligned with openings 96, is defined when two display panels 22, 22' are mounted adjacent one another. Clips 248 having a planar body 250 and a pair of hooks 252 are used to retain side edges 244 of panels 22 against struts 18. Hooks 252 are adapted to be received through and retained in a pair of openings 96 in a conventional manner, and are sized such that the rear face 254 of body 250 snugly engages the outer surface 256 of each display panel 22. Gap 246 additionally permits the installation of shelves, lighting fixtures, etc.

Walls 20 may also be fitted with septum panels 23 to form a closed frame structure. Septum panels 23 are secured in place by septum frames 260 which are secured along the convex surfaces 125, 127 of rails 14, 16. Septum panels 23 are identical to display panels 22 in variety and form. However, septum panels 23 are shorter in height since they are mounted between the ridges of the body portions 24, 66 and not in outer channels 40, 80.

Each septum frame 260 is comprised of a main member 262 and an attachment 264. Preferably, the septum frame components 262, 264 are composed of a plastic material, put could of course be composed of a variety of materials having the requisite characteristics. Furthermore, septum frame components 262, 264 are preferably fabricated by extrusion techniques, although other manufacturing processes could be used.

Main member 262 of each septum frame 260 includes an arcuate base 266 which is curved to correspond and engage the convex surface 125, 127 of one of the rails 14, 16. Arcuate bases 266, are attached to rails 14, 16 through the use of screws (not shown) or other known means. Projecting upwardly from the mid-section of each arcuate base 266 is a generally T-shaped portion having a vertical retaining wall 268 and a horizontally extending segment 270. Horizontal segment 270 is spaced slightly from and overlies the ridge portion 272 of base 266. The opposing faces 274, 276 of horizontal segment 270 and ridge portion 272 are preferably serrated 281 to securely mount attachment 264, as described below.

Attachment 264 of each septum frame 260 is fabricated as a T-shape member having a vertical retaining wall 278 and a horizontal prong 280. Prong 280 is provided with a plurality of elongated, tapered barbs 282 along its length. Prong 280 is sized and adapted to be matingly received between opposing faces 274, 276 of main member 262. When prong 280 is so inserted barbs 282 interlock with serrations 281 to securely hold attachment 264 in place. Nevertheless, barbs 282 are flexible so that attachment 264 may be manually pried from main member 262. This permits the septum panels 23 to be easily removed and replaced. Vertical retaining wall 278 is substantially parallel to vertical retaining wall 268, and cooperatively forms a septum channel 284 with wall 268 and segment 270. Septum channels 284 are adapted to receive and hold septum panels 23 in place.

Figure 28:
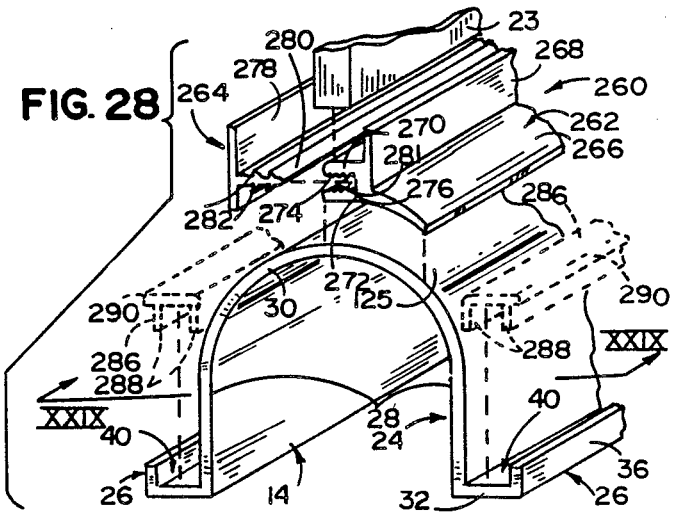
FIG. 28 is a fragmentary, exploded perspective view of the bottom rail and a septum display panel.
Figure 27:
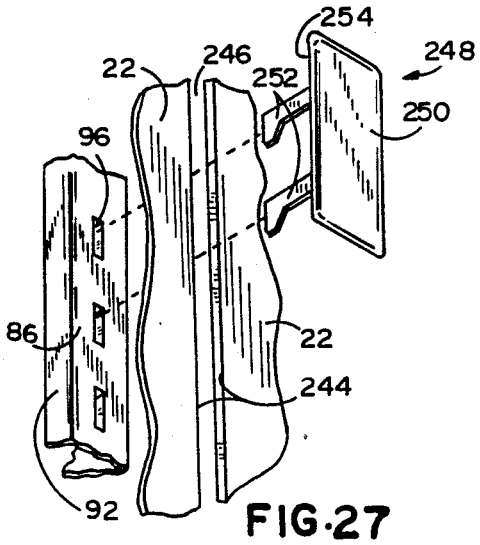
FIG. 27 is a fragmentary, exploded perspective view of a clip securing two adjacent display panels.

Moreover, since struts 18 are not directly involved with the securing of septum panels 23, covers 212 may be used in conjunction with such septum panels. Additionally, channel inserts 286 may be installed in outer channels 40, 80 to thereby reduce their visual impact to the public. Channel inserts 286 are preferably extruded plastic members of various shapes, sizes and colors. For example, as shown in FIGS. 28 and 29, inserts 286 may be provided with two downwardly extending holding legs 288 and a top cover member 290. Further, as with covers 212B, inserts 286 may be mixed and matched in any desired manner.

Figure 32:
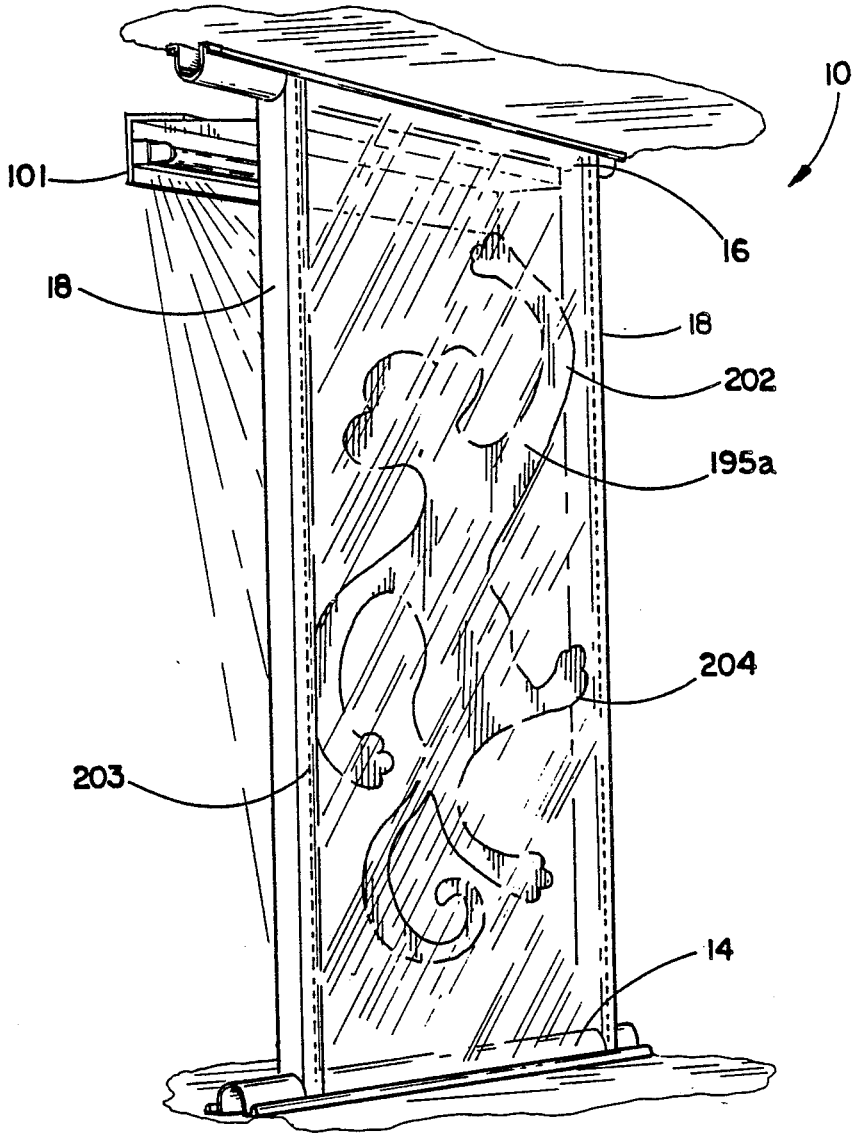
FIG. 32 is a fragmentary perspective view of an alternative construction creating a silhouette display.

A wall structure including display panels 22 or septum panels 23 may be provided with lighting fixtures (FIG. 32) and opaque figurines 292 or opaque inserts 195, to create an attractive silhouette appearance for the assembled display. In general, the opaque inserts or figurines 195, 292 are placed between a translucent panel 22 or 23 and a lighting fixture. The radiating light, then, creates a silhouette which may be seen through the translucent panel 22 or 23. The lighting fixtures may be positioned between the rails, outside the rails or eliminated if sufficient lighting exists behind the wall.

Opaque figurines 292 are preferably very thin planar members composed of plastic or other material. Figurines 292 are mounted flush against the translucent panel 22 or 23. More specifically, figurines 292 are received within one or both of the side channels 40, 80 when used in conjunction with side display panels 22. This places the figurines snugly between the rear surface 294 of translucent panel 22 and leg 28 or 68 of body portions 24 or 66, respectively. When a figurine 292 is used in conjunction with a translucent septum panel 23, the figurine 292 is received within the septum channel 284 between the rear surface 296 of the translucent septum panel 23 and the first or second retaining wall 268 or 278 of septum frame 260.

When utilizing structural inserts 195 as the opaque component, panels 22 or 23 and inserts 195 are mounted in the same manners as discussed previously. More specifically, side panels 22 are received inside channels 40, 80 and structural inserts 195 are mounted to side walls 88 of adjacent struts 18. Alternatively, septum panels 23 are mounted in septum frames 260 along rails 14, 16 and structural inserts are mounted on sidewalls 88 of adjacent struts 18. In this latter configuration, structural inserts 195 must be attached before inserting septum panels 23 in system frames 260, since panels 23 will overlie securing flanges 197. In this arrangement, as can be readily appreciated, insert 195 will be positioned in close proximity to system panel 23, if not engaged therewith.

In any event, the lighting fixtures may be secured with conventional bracket hooks in the same manner as cornice 101 (FIG. 1), or in any other known manner. Additionally, if desired, lighting fixtures may be separately positioned on floor 34 in a spaced apart relation from wall 20.

The above description is that of preferred embodiments of the invention. Various alterations and changes can be made without departing from the spirit and broader aspects of the invention as set forth in the appended claims, which are to be interpreted in accordance with the principle of patent law, including the Doctrine of Equivalents.

The embodiments of the invention in which an exclusive property or privilege is claimed are defined as follows:

1. A partition system comprising:

top rail;

a bottom rail;

a plurality of vertical struts interconnecting said top and bottom rails;

at least one lighting fixture;

at least one translucent display panel secured to at least one of said top rail, bottom rail and struts;

at least one structural insert including a generally planar body having a irregular perimeter shape and a plurality of securing flanges extending at right angles to said body, said insert being positioned between a pair of adjacent struts so that at least one securing flange engages each of said adjacent struts, said insert being an opaque member; and fastening means for securely attaching each said securing flange to its engaged strut, said translucent panel, said opaque insert and said lighting fixture all being aligned with one another between at least one pair of struts, such that said insert is positioned between said translucent panel and said lighting fixture, so that a silhouette of said opaque insert is seen through said translucent panel.

2. A wall system as defined in claim 1 in which said lighting fixture is secured to and supported by at least one of said struts.

3. A wall system as defined in claim 1 in which said top and bottom rails each define a longitudinal axis and include at least one side channel which cooperates with the side channel of the other rail to secure and support said translucent panel, and in which said insert is positioned and secured in substantial alignment with said longitudinal axes of said top and bottom rails.

4. A wall system as defined in claim 1 in which said top and bottom rails each define a longitudinal axis and in which said translucent panel and said insert are mounted in close proximity with one another and in substantial alignment with said longitudinal axes of said top and bottom rails.

5. An upright, floor standing partition system comprising:

a bottom rail positioned on and supported by a floor surface;

a top rail positioned above said bottom rail in a spaced apart relationship therewith;

a plurality of vertical struts interconnecting said top and bottom rails to form a partition framework defining at least one substantially rectangular opening;

at least one structural insert including a body having an irregular, non-rectangular perimeter shape and a plurality of securing portions engaging said struts, said insert being positioned between said vertical struts such that said body only covers a portion of said opening significantly less than the entire opening; and fastening means for securely attaching said securing portions of said insert to said struts so that said structural insert rigidifies said partition framework and additionally presents an aesthetically pleasing display.

6. A partition system as defined in claim 5 in which said securing portions project from said body at substantially right angles thereto.

7. A partition system as defined in claim 5 which further comprises at least one translucent display panel attached to said partition framework to extend between said vertical struts, wherein said insert and display panel are in general alignment with one another such that a silhouette of said insert is seen through said translucent panel to a viewer on a side of said panel opposite said insert.

8. A partition system as defined in claim 7 further comprising a light fixture positioned to a side of said insert opposite said display panel and directing light toward said insert and display panel to highlight the insert silhouette visible through said display panel.

9. A partition system as defined in claim 7 wherein said top and bottom rails each define a pair of opposite sides and a longitudinal axis, wherein said display panel is positioned substantially along one of said sides of each of said top and bottom rails, and wherein said insert is positioned in substantial alignment with said longitudinal axis of said top and bottom rails.

10. A partition system as defined in claim 7 wherein said top and bottom rails each define a longitudinal axis, and wherein said display panel and said insert are mounted in close proximity with one another and in substantial alignment with said longitudinal axis of said top and bottom rails.

11. An upright, floor standing partition system for dividing floor space comprising:

an upright, floor standing framework including a bottom rail positioned on and supported by a floor surface, a top rail positioned above said bottom rail in a spaced apart relationship therewith, a plurality of vertical struts interconnecting said top and bottom rials and defining at least one rectangular opening, and at least one channel structure;

at least one translucent panel secured in said channel structure of said framework;

at least one structural insert including a planar body having an irregular, non-rectangular perimeter shape and a plurality of securing portions oriented at right angles to said body and engaging said struts, said insert being positioned between said struts such that said body only covers a portion of said opening significantly less than the entire opening, said insert being substantially opaque;

fastening means for securely attaching said securing portions of said insert to said struts so that said structural insert rigidifies said partition framework; and at least one light fixture secured to said partition framework and positioned to one side of said structural insert opposite said panel, said light fixture, said structural insert and said panel being aligned with said insert positioned between said light fixture and said panel so that a silhouette of said insert is visible through said panel to a viewer to one side of said panel opposite said insert.

* * * * *

UNITED STATES PATENT AND TRADEMARK OFFICE

CERTIFICATE OF CORRECTION

PATENT NO. : 4,980,998

DATED : January 1, 1991

INVENTOR(S) : Douglas D. Amstutz et al

It is certified that error appears in the above-identified patent and that said Letters Patent is hereby corrected as shown below:

Claim 1, Column 10, Line 60:
before "top" insert --a--.

Signed and Sealed this

Twenty-eighth Day of April, 1992

*Attest:*

HARRY F. MANBECK, JR.

*Attesting Officer*

*Commissioner of Patents and Trademarks*